US008918325B2

(12) United States Patent
Kimura et al.

(10) Patent No.: US 8,918,325 B2
(45) Date of Patent: Dec. 23, 2014

(54) SIGNAL PROCESSING DEVICE FOR PROCESSING STEREO SIGNALS

(75) Inventors: Masaru Kimura, Tokyo (JP); Bunkei Matsuoka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 244 days.

(21) Appl. No.: 13/260,049

(22) PCT Filed: May 17, 2010

(86) PCT No.: PCT/JP2010/003310
§ 371 (c)(1),
(2), (4) Date: Sep. 23, 2011

(87) PCT Pub. No.: WO2010/140306
PCT Pub. Date: Dec. 9, 2010

(65) Prior Publication Data

US 2012/0014485 A1 Jan. 19, 2012

(30) Foreign Application Priority Data

Jun. 1, 2009 (JP) ..... 2009-132158

(51) Int. Cl.

| | |
|---|---|
| ***G10L 19/00*** | (2013.01) |
| ***G10L 19/26*** | (2013.01) |
| ***H04S 7/00*** | (2006.01) |
| *G10L 25/12* | (2013.01) |
| *G10L 19/008* | (2013.01) |
| *H04S 1/00* | (2006.01) |

(52) U.S. Cl.
CPC . *G10L 19/26* (2013.01); *H04S 7/30* (2013.01); *G10L 25/12* (2013.01); *G10L 19/008* (2013.01); *H04S 1/007* (2013.01)
USPC ..... 704/500; 704/230; 455/97; 455/130; 381/17; 341/50; 341/60; 341/143

(58) Field of Classification Search
CPC ..... G10L 19/008; G10L 19/24; G10L 19/167; G10L 21/038; G11B 20/10527
USPC ..... 704/500
See application file for complete search history.

(56) References Cited

U.S. PATENT DOCUMENTS 4,075,655 A * 2/1978 Iijima et al. ..... 348/394.1
5,511,093 A * 4/1996 Edler et al. ..... 375/240

(Continued)

FOREIGN PATENT DOCUMENTS

CN 1647158 A 7/2005
CN 1942017 A 4/2007

(Continued)

OTHER PUBLICATIONS

Extended European Search Report issued Mar. 5, 2013 in Patent Application No. 10783094.5.

(Continued)

*Primary Examiner* — Pierre-Louis Desir
*Assistant Examiner* — Fariba Sirjani
(74) *Attorney, Agent, or Firm* — Oblon, Spivak, McClelland, Maier & Neustadt, L.L.P.

(57) ABSTRACT

A signal processing device is provided, including a prediction error calculating unit that calculates an error signal between a left signal l(n) and a prediction signal of the left signal l (n) predicted from a right signal r(n), a gain adjusting unit that makes a gain adjustment and outputs an error signal, a first adder that adds the left signal l(n) and the error signal and outputs, and a second adder that adds the right signal r(n) and the error signal in opposite phase and outputs.

5 Claims, 3 Drawing Sheets

(56) References Cited

U.S. PATENT DOCUMENTS

| | | | | |
|---|---|---|---|---|
| 6,111,958 | A * | 8/2000 | Maher | 381/17 |
| 6,470,087 | B1 * | 10/2002 | Heo et al. | 381/17 |
| 6,810,124 | B1 * | 10/2004 | White | 381/71.1 |
| 6,856,790 | B1 * | 2/2005 | He | 455/63.4 |
| 7,084,797 | B2 * | 8/2006 | Yokoyama et al. | 341/143 |
| 7,392,195 | B2 * | 6/2008 | Fejzo | 704/500 |
| 7,466,245 | B2 * | 12/2008 | Unno | 341/50 |
| 7,466,831 | B2 * | 12/2008 | Magrath | 381/103 |
| 7,991,012 | B2 * | 8/2011 | Liebchen | 370/477 |
| 8,306,243 | B2 * | 11/2012 | Kimura et al. | 381/97 |
| 8,620,651 | B2 * | 12/2013 | Chen | 704/230 |
| 2002/0091514 | A1 * | 7/2002 | Fuchigami | 704/230 |
| 2004/0176056 | A1 * | 9/2004 | Feng | 455/130 |
| 2004/0190649 | A1 * | 9/2004 | Endres et al. | 375/326 |
| 2005/0213522 | A1 | 9/2005 | Aarts et al. | |
| 2006/0083381 | A1 * | 4/2006 | Magrath | 381/17 |
| 2006/0109986 | A1 * | 5/2006 | Ko | 381/17 |
| 2006/0251261 | A1 * | 11/2006 | Christoph | 381/1 |
| 2006/0276915 | A1 * | 12/2006 | Kelly | 700/44 |
| 2007/0076892 | A1 | 4/2007 | Kim | |
| 2007/0140502 | A1 | 6/2007 | Kauppinen | |
| 2008/0106445 | A1 | 5/2008 | Unno | |
| 2009/0022328 | A1 * | 1/2009 | Neugebauer et al. | 381/27 |
| 2009/0119111 | A1 * | 5/2009 | Goto et al. | 704/500 |
| 2010/0172505 | A1 * | 7/2010 | Kimura et al. | 381/1 |
| 2010/0322429 | A1 * | 12/2010 | Norvell et al. | 381/22 |

FOREIGN PATENT DOCUMENTS

| | | | |
|---|---|---|---|
| GB | 2 074 823 | A | 11/1981 |
| GB | 2 419 265 | A | 4/2006 |
| JP | 2007 47813 | | 2/2007 |
| JP | 2008 33269 | | 2/2008 |
| JP | 2008 102206 | | 5/2008 |
| WO | WO 2007/035072 | A1 | 3/2007 |
| WO | 2007 088853 | | 8/2007 |

OTHER PUBLICATIONS

U.S. Appl. No. 13/257,004, filed Sep. 19, 2011, Kimura et al.

International Search Report issued Jun. 15, 2010 in PCT/JP10/003310 filed May 17, 2010.

Extended European Search Report issued Mar. 5, 2013 in European Patent Application No. 10783094.5.

Hendrik Fuchs, "Improving Joint Stereo Audio Coding by Adaptive Inter-Channel Prediction", IEEE Workshop on Applications of Signal Processing to Audio and Acoustics, XP000570718, Oct. 17, 1993, pp. 39-42.

Combined Chinese Office Action and Search Report issued Dec. 4, 2013 in Patent Application No. 201080022457.2 (with English language translation).

* cited by examiner

SIGNAL PROCESSING DEVICE FOR PROCESSING STEREO SIGNALS

TECHNICAL FIELD

The present invention relates to a signal processing device for decoding and reproducing a compression-encoded audio signal, for example.

BACKGROUND ART

Generally, the more the audio signal to be reproduced has spatial information, the richer a sound field feeling or atmospheric feeling becomes when reproducing an audio signal, and the spatial information appears in the difference between the left and right signals (referred to as a left-and-right difference signal, from now on).

On the other hand, techniques have been spread recently which save the capacity of a storage device for storing audio signals or save the amount of communications of transmission and reception by carrying out compression encoding such as AAC (Advanced Audio Codec) or MP3 (MPEG Audio Layer 3) rather than by using audio CDs.

The compression-encoded audio signal has deteriorated characteristics like a tooth missing such as a lack of a high-frequency component and missing part of a middle- and high-frequency spectrum of the left-and-right difference signal. Playing back such an audio signal with its characteristics being deteriorated has a tendency to cause a muffled sound because of the lack of the high-frequency component, and a tendency to degenerate a sound field feeling and atmospheric feeling because of the deterioration in the characteristics of the left-and-right difference signal.

Accordingly, a signal processing device capable of improving the quality of sound of the compression-encoded audio signal is disclosed (see Patent Document 1). According to the Patent Document 1, it extracts a high-frequency component and low-frequency component of a peak value of an input audio signal and adds them, thereby being able to recover the high-frequency component missed because of the signal compression encoding and to lessen the muffled sound.

PRIOR ART DOCUMENT

Patent Document

Patent Document 1: Japanese Patent Laid-Open No. 2008-102206.

DISCLOSURE OF THE INVENTION

Although the foregoing conventional signal processing device can lessen the muffled sound by recovering the high-frequency component missing from the audio signal, for example, it cannot restore the characteristics of the left-and-right difference signal of the audio signal before the compression encoding, thereby offering a problem of being unable to recover the rich sound field feeling and atmospheric feeling.

The present invention is implemented to solve the foregoing problem. Therefore it is an object of the present invention to provide a signal processing device capable of restoring the characteristics of the signal before the compression encoding.

A signal processing device in accordance with the present invention comprises a prediction error calculating unit that receives first and second signals and calculates an error signal between the first signal and a prediction signal of the first signal predicted from the second signal, a first adder for adding the first signal and the error signal, and a second adder for adding the second signal and an error signal.

According to the present invention, since it is configured in such a manner that the prediction error calculating unit computes the error signal between the first signal and the prediction signal of the first signal predicted from the second signal, that the first adder adds the first signal and the error signal, and that the second adder adds the second signal and the error signal, it can restore the characteristics of the signal before the compression encoding. As a result, it can recover the characteristics of the left-and-right difference signal of the stereo audio signal, for example, and thus restore the rich sound field feeling and atmospheric feeling.

BRIEF DESCRIPTION OF THE DRAWINGS

FIG. 3(*a*) shows the phase relationship when the correlation between the left signal frequency spectrum and the right signal frequency spectrum is weak; and FIG. 3(*b*) shows the phase relationship when the correlation between the left signal frequency spectrum and the right signal frequency spectrum is strong;

EMBODIMENTS FOR CARRYING OUT THE INVENTION

The embodiments of the invention will now be described in detail with reference to the accompanying drawings. Incidentally, the following description will be made on the assumption that a signal processing device of an embodiment in accordance with the present invention is applied to an audio device, and that it processes left and right signals of a stereo audio signal as first and second input signals having correlation.

Embodiment 1

Figure 1:
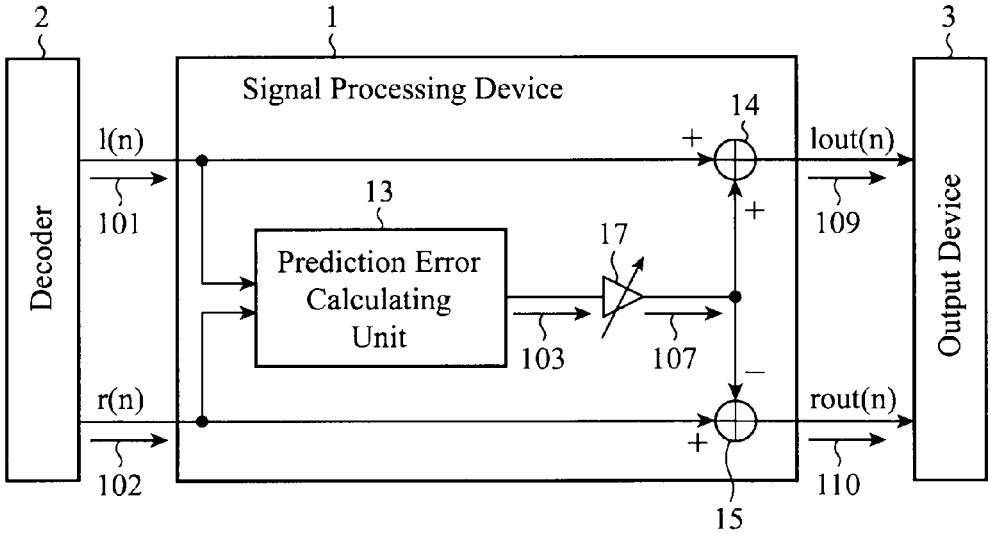
FIG. 1 is a block diagram showing a configuration of a signal processing device of an embodiment 1 in accordance with the present invention.

FIG. 1 is a block diagram showing a configuration of a signal processing device of an embodiment 1 in accordance with the present invention 1.

As shown in FIG. 1, a signal processing device 1 is placed between a decoder 2 and an output device 3, carries out signal processing of a difference signal between a left signal l(n) 101 (first signal) and a right signal r(n) 102 (second signal) input from the decoder 2 as the stereo audio signal, and supplies improved left signal lout(n) 109 and right signal rout(n) 110 to the output device 3.

Incidentally, the decoder 2 is a device that decodes the compressed-encoded audio data and outputs as the stereo audio signal, and the output device 3 is a device that converts the stereo audio signal into acoustic vibration and outputs it, such as a speaker.

As shown in FIG. 1, the signal processing device 1 comprises a prediction error calculating unit 13, a first adder 14, a second adder 15, and a gain adjusting unit 17. The prediction error calculating unit 13, which will be described later, calculates an error signal 103 from the left signal l(n) 101 and right signal r(n) 102 of the stereo audio signal as an improving difference signal for improving the left-and-right difference signal.

The gain adjusting unit 17 is a multiplier that controls the gain by multiplying the error signal 103 by a prescribed value, and that outputs an error signal 107 after the gain adjustment as the improving difference signal.

The first adder 14 adds the left signal l(n) 101 and the error signal 107 in phase and outputs as the left signal lout(n) 109. The second adder 15 adds the right signal r(n) 102 and the error signal 107 in opposite phase, and outputs as the right signal rout(n) 110.

Next, the processing operation of the signal processing device 1 will be described.

As shown in FIG. 1, the signal processing device 1, receiving the left signal l(n) 101 and right signal r(n) 102 from the external decoder 2 as the stereo audio signal, splits the input left signal l(n) 101 and right signal r(n) 102, each.

The signal processing device 1 leads a first left signal l(n) 101 of the split left signal l(n) 101 to the prediction error calculating unit 13 and a second left signal l(n) 101 thereof to the first adder 14. Likewise, the signal processing device 1 leads a first right signal r(n) 102 of the split right signal r(n) 102 to the prediction error calculating unit 13 and a second right signal r(n) 102 thereof to the second adder 15.

According to the left signal l(n) 101 and right signal r(n) 102 supplied, the prediction error calculating unit 13 calculates the error signal 103 as an improving difference signal for improving the left-and-right difference signal of the stereo audio signal, and supplies it to the gain adjusting unit 17. The detailed processing operation of the prediction error calculating unit 13 will be described later.

The gain adjusting unit 17 controls the gain of the error signal 103 fed from the prediction error calculating unit 13 by multiplying it by a preset fixed value or a value that can be set properly from an external control panel or the like not shown, and outputs the error signal 107 after the gain adjustment as the improving difference signal.

The error signal 107 output from the gain adjusting unit 17 is split so that a first error signal 107 is supplied to the first adder 14 and a second error signal 107 is supplied to the second adder 15.

The first adder 14 adds the left signal l(n) 101 and the error signal 107 from the gain adjusting unit 17 in phase, and supplies the left signal lout(n) 109 to the external output device 3 as the output signal after the signal processing.

In contrast, the second adder 15 inverts the phase of the error signal 107 fed from the gain adjusting unit 17, and adds the right signal r(n) 102 and the phase-inverted error signal 107, and supplies the right signal rout(n) 110 to the external output device 3 as the output signal after the signal processing. In other words, the second adder 15 subtracts the error signal 107 from the right signal r(n) 102 and outputs it.

Thus, the first adder 14 and second adder 15 add the split error signal 107 to the left signal l(n) 101 and right signal r(n) 102 in opposite phases.

Incidentally, although the signal processing device 1 of the embodiment 1 has a configuration of making the gain adjustment of the error signal 103 with the gain adjusting unit 17, a configuration is also possible which removes the gain adjusting unit 17 as needed.

Next, a concrete configuration of the prediction error calculating unit 13 will be described.

Figure 2:
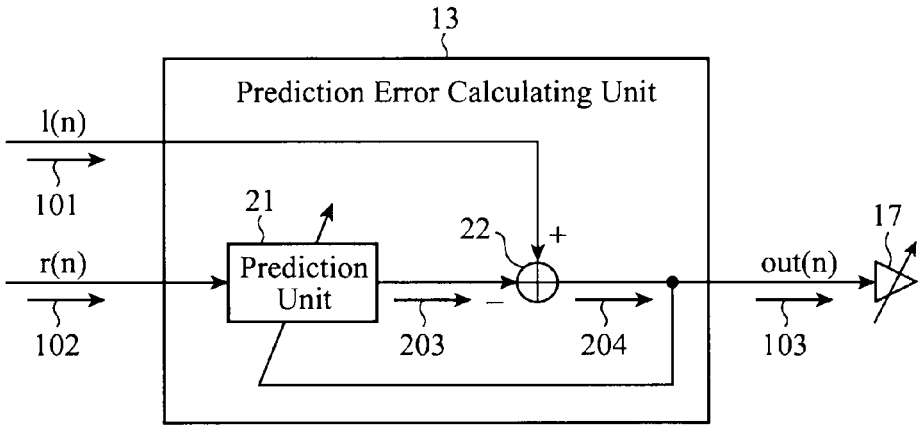
FIG. 2 is a block diagram showing a configuration of the prediction error calculating unit of the embodiment 1.

FIG. 2 is a block diagram showing a configuration of the prediction error calculating unit 13 of the embodiment 1.

As shown in FIG. 2, the prediction error calculating unit 13, which comprises a prediction unit 21 and a signal calculating unit 22, calculates the error signal 103 from the input left signal l(n) 101 and right signal r(n) 102, and outputs it as the improving difference signal.

The prediction unit 21, which predicts the left signal l(n) 101 from the input right signal r(n) 102, previously input right signals r(n−1), r(n−2), r(n−3), . . . , r(n−N) and prediction coefficients and outputs as a prediction signal 203, is an AR prediction unit using a known AR (Auto-Regressive) prediction technique, for example. Here, N is a prediction order.

Incidentally, a configuration is also possible which comprises a delay unit not shown for delaying the input right signal r(n) 102 by one sample, predicts the left signal l(n) 101 from the one-sample delayed right signal r(n−1) 102, the previously input right signals r(n−2), r(n−3), r(n−4), . . . , r(n−1−N) and the prediction coefficients, and outputs as the prediction signal 203.

The signal calculating unit 22, which is an adder for inverting the phase of the input prediction signal 203 and adds the phase-inverted prediction signal 203 to the left signal l(n) 101, calculates an error signal 204 as a prediction error and outputs it.

In addition, the prediction unit 21 receives the error signal 204 from the signal calculating unit 22, and updates the prediction coefficients according to the error signal 204 using a known learning algorithm at every sampling time.

Next, the processing operation of the prediction error calculating unit 13 will be described.

The prediction error calculating unit 13 receives the left signal l(n) 101 and right signal r(n) 102 as the stereo audio signal, and leads the left signal l(n) 101 to the signal calculating unit 22 and the right signal r(n) 102 to the prediction unit 21.

Receiving the right signal r(n) 102, the prediction unit 21 AR predicts the left signal l(n) 101 from the right signals r(n) 102 and prediction coefficients, and supplies it to the signal calculating unit 22 as the prediction signal 203.

The signal calculating unit 22 inverts the phase of the prediction signal 203 fed from the prediction unit 21, adds the phase-inverted prediction signal 203 and the left signal l(n) 101, and outputs the error signal 204 as the prediction error of the prediction signal 203.

The prediction error calculating unit 13 splits the error signal 204 output from the signal calculating unit 22, outputs a first error signal 204 as the error signal 103 and returns a second error signal 204 to the prediction unit 21.

Receiving the error signal 204 and according to the error signal 204, the prediction unit 21 updates the prediction coefficients using a known learning algorithm such as a steepest descent method and learning identification method.

Incidentally, although the prediction unit 21 is supplied with the right signal r(n) 102 and the signal calculating unit 22 is supplied with the left signal l(n) 101, the left signal l(n) 101 and the right signal r(n) 102 can be exchanged. Thus, a configuration can suffice as long as it predicts a second signal from a first signal or vice versa.

In addition, although a configuration has been described in which the prediction unit 21 successively updates the prediction coefficients at every sampling time, a configuration is also possible which updates the prediction coefficients at once at any given point of time or which employs a prediction unit 21 using fixed prediction coefficients designated in advance without carry out the successive update.

Next, the advantages of the signal processing device 1 of the embodiment 1 will be described.

First, characteristics of the left-and-right difference signal of the stereo audio signal will be described.

Figure 3:
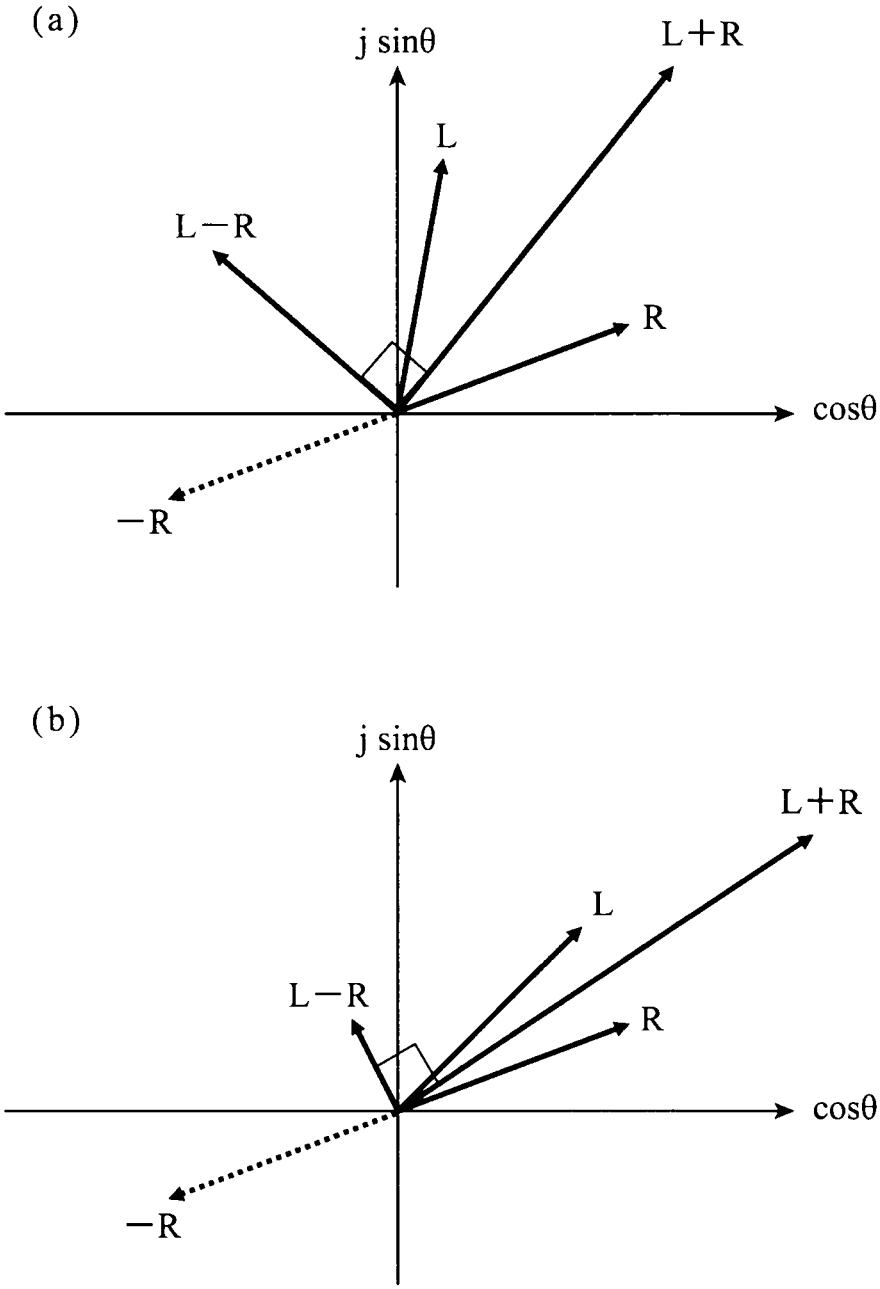
FIG. 3 is a diagram showing phase relationships between a frequency spectrum of a left-and-right sum signal and that of a left-and-right difference signal in the signal processing device of the embodiment 1.

FIG. 3 is a diagram showing phase relationships between the signal frequency spectrum of the left-and-right sum signal and that of the left-and-right difference signal when the spectral intensity of the left signal is nearly equal to that of the right signal at a frequency θ. FIG. 3(*a*) shows a case where the correlation between the left signal frequency spectrum and the right signal frequency spectrum is weak, and FIG. 3(*b*) shows a case where the correlation between the left signal frequency spectrum and the right signal frequency spectrum is strong.

As shown in FIG. 3(*a*) and FIG. 3(*b*), when the left signal and right signal have nearly the same spectral intensity, the phase of the frequency spectrum of the left-and-right sum signal and the phase of the frequency spectrum of the left-and-right difference signal are orthogonal regardless of the correlation (magnitude of the phase difference) between the frequency spectrum of the left signal and that of the right signal.

Here, since the left-and-right sum signal is an in-phase component of the left signal l(n) 101 and right signal r(n) 102, the left-and-right sum signal is a correlation component between the left signal l(n) 101 and signal r(n) 102 when disregarding a time delay (when a time delay is zero), and the left-and-right difference signal orthogonal to the left-and-right sum signal is an uncorrelated component between the left signal l(n) 101 and right signal r(n) 102 when disregarding a time delay (when a time delay is zero).

On the other hand, the present embodiment 1 employs an AR prediction unit as the prediction unit 21, and the AR prediction unit enables optimum prediction that satisfies Wiener-Hopf equations as long as the signal conforms to an AR model. That the optimally predicted prediction signal is orthogonal to the error signal between the prediction signal and reference signal is known as "orthogonal principle".

In addition, a steady signal with a harmonic structure can be expressed in an AR model. In the present embodiment 1, since the stereo audio signal such as instrumental sounds and voice has a harmonic structure and can be considered as a steady signal when observed in a short time period, the stereo audio signal can be assumed as an AR model.

Here, because the prediction signal 203 predicted by the AR prediction unit (prediction unit 21 shown in FIG. 2) can be considered as a common signal component of the left signal l(n) 101 and right signal r(n) 102, it is a correlation component between the left signal l(n) 101 and right signal r(n) 102 when considering the time delay. In contrast, since the error signal 204 is orthogonal to the correlation component, it is an uncorrelated component between the left signal l(n) 101 and right signal r(n) 102 when considering the time delay. Thus, the prediction error calculating unit 13 of the present embodiment 1 can separate the left signal l(n) 101 and right signal r(n) 102 to the correlation component and uncorrelated component.

In this way, since the error signal 103 is the uncorrelated component of the left and right signals considering the time delay and the left-and-right difference signal is the uncorrelated component of the left and right signals when the time delay is zero, they have the same quality. Accordingly, the signal processing device 1 of the embodiment 1 can restore the frequency spectrum of the left-and-right difference signal using the error signal 103.

Figure 4:
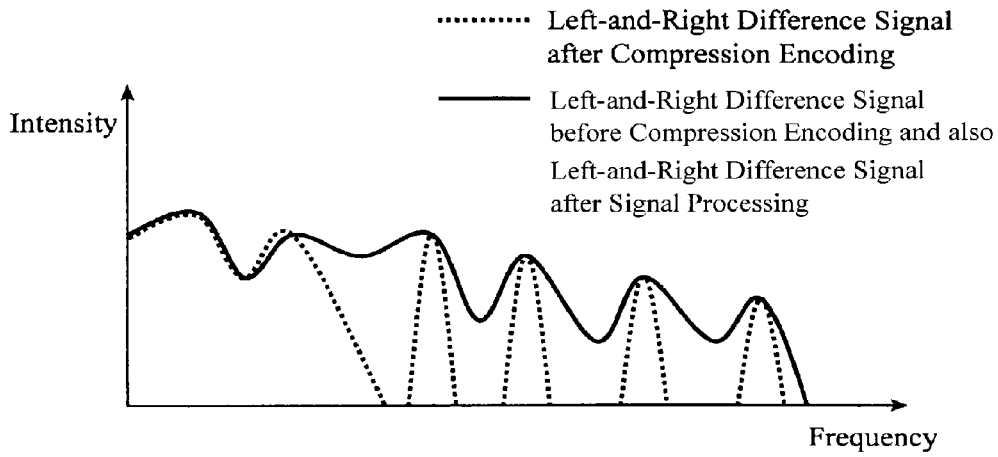
FIG. 4 is a diagram showing, in the signal processing device of the embodiment 1, deterioration in the left-and-right difference signal owing to the compression encoding, and restoration of the left-and-right difference signal after the signal processing by the signal processing device.

FIG. 4 is a diagram showing deterioration of the left-and-right difference signal due to the compression encoding and the restoration of the left-and-right difference signal after the signal processing by the signal processing device 1. As shown in FIG. 4, a solid line denotes a frequency spectrum of the left-and-right difference signal before the compression encoding and that of the left-and-right difference signal after the signal processing, and broken lines denote a frequency spectrum of the left-and-right difference signal after the compression encoding. The solid line represents both the signal before undergoing compression encoding and the signal after being restored by the signal processing device in accordance with the present invention.

Although the frequency spectrum of the left-and-right difference signal before the compression encoding denoted by the solid line in FIG. 4 is continuous, the left-and-right difference signal after the compression encoding denoted by the broken lines in FIG. 4 lacks part of the frequency spectrum, and becomes like a tooth missing and deteriorates its characteristics, thereby reducing the spatial information and degenerating the sound field feeling and atmospheric feeling.

Thus, according to the signal processing device 1 of the embodiment 1, it can recover the frequency spectrum of the left-and-right difference signal before the compression encoding from the frequency spectrum of the left-and-right difference signal deteriorated because of the compression encoding, thereby being able to restore the spatial information and to achieve the rich sound field feeling and atmospheric feeling.

As described above, according to the signal processing device 1 of the embodiment 1, since it is configured in such a manner that the prediction error calculating unit 13 receives the left signal l(n) 101 and right signal r(n) 102, that the prediction unit 21 predicts the left signal l(n) 101 from the input right signal r(n) 102 and the prediction coefficients and outputs it as the prediction signal 203, that the signal calculating unit 22 adds the phase-inverted prediction signal 203 and the left signal l(n) 101 and outputs the error signal 204, and that the first adder 14 and second adder 15 add the error signal 107 to the left signal l(n) 101 and right signal r(n) 102 in opposite phase relationships, respectively. Accordingly, it can recover the frequency spectrum before the compression encoding from the left-and-right difference signal of the stereo audio signal, thereby offering an advantage of being able to obtain the rich sound field feeling or atmospheric feeling when playing back the stereo audio signal.

In addition, according to the signal processing device 1 of the embodiment 1, since it employs the AR prediction unit that makes the AR prediction as the prediction unit 21, if offers an advantage of being able to carry out high accuracy prediction.

Furthermore, according to the signal processing device 1 of the embodiment 1, since it is configured in such a manner that the AR prediction unit working as the prediction unit 21 updates the prediction coefficients in accordance with the error signal 204, it offers an advantage of being able to make the prediction at high accuracy.

Furthermore, according to the signal processing device 1 of the embodiment 1, since it comprises the gain adjusting unit 17 that adjusts the gain of the error signal 103 and outputs the error signal 107 after the adjustment as the improving difference signal, it can control the degree of improvement of the sound field feeling and atmospheric feeling of the stereo audio signal.

Moreover, as for the coefficient of the gain adjusting unit 17, since the present embodiment can set it at a variable value that can be set appropriately, it can adjust the degree of the improvement of the sound field feeling and atmospheric feeling of the stereo audio signal in a finer manner.

Incidentally, although the signal processing device 1 of the embodiment 1 is described by way of example of a signal processing device that processes the stereo audio signal of the audio device as the first and second input signals, for example, it can handle not only the stereo audio signal, but also two input signals having some degree of correlation between them.

Embodiment 2

In the embodiment 1, the configuration is described in which the prediction error calculating unit 13 calculates the error signal 103 between the prediction signal 203 and the left signal l(n) 101, the first adder 14 adds the left signal l(n) 101 and the error signal 103, and the second adder 15 adds the right signal r(n) 102 and the error signal 103 in opposite phase. In the embodiment 2, however, a configuration that adjusts the improving difference signal in a finer manner will be described.

Figure 5:
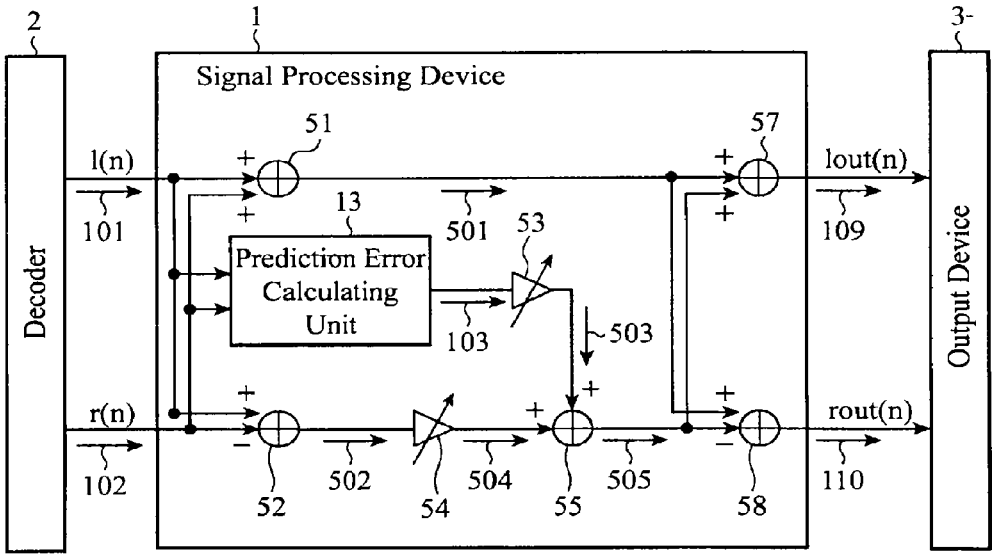
FIG. 5 is a block diagram showing a configuration of a signal processing device of an embodiment 2 in accordance with the present invention.

FIG. 5 is a block diagram showing a configuration of the signal processing device 1 of the embodiment 2 in accordance with the present invention. Incidentally, in FIG. 5, the same or like components to those of the embodiment 1 are designated by the same reference numerals, and their detailed description will be omitted here.

As shown in FIG. 5, the signal processing device 1 comprises the prediction error calculating unit 13, a first adder 51, a second adder 52, a third adder 55, a fourth adder 57, a fifth adder 58, a first gain adjusting unit 53, and a second gain adjusting unit 54. The prediction error calculating unit 13, in the same manner as in the embodiment 1, calculates the error signal 103 from the left signal l(n) 101 (first signal) and right signal r(n) 102 (second signal) of the stereo audio signal as the improving difference signal for improving the left-and-right difference signal.

The first adder 51, third adder 55 and fourth adder 57 add their two input signals in phase, but the second adder 52 and fifth adder 58 add the two input signals with the phase of their first signal being inverted.

The first gain adjusting unit 53 and second gain adjusting unit 54 are a multiplier for multiplying the input signal by a prescribed value, and output as a signal with its gain being adjusted.

Next, the processing operation of the signal processing device 1 of the embodiment 2 will be described.

As shown in FIG. 5, when the signal processing device 1 receives the left signal l(n) 101 and right signal r(n) 102 from the external decoder 2 as the stereo audio signal, it splits the input left signal l(n) 101 and right signal r(n) 102 in three, respectively.

The signal processing device 1 leads the split left signal l(n) 101 to the prediction error calculating unit 13, first adder 51 and second adder 52. Likewise, the signal processing device 1 leads the split right signal r(n) 102 to the prediction error calculating unit 13, first adder 51 and second adder 52.

The first adder 51 receives and adds the left signal l(n) 101 and right signal r(n) 102, and supplies to the fourth adder 57 and fifth adder 58 as a first addition signal 501.

In the same processing operation as that of the embodiment 1, the prediction error calculating unit 13 calculates, from the input left signal l(n) 101 and right signal r(n) 102, the error signal 103 between the left signal l(n) 101 and the prediction signal that estimates the left signal l(n) 101, and supplies the error signal 103 to the first gain adjusting unit 53 as the improving difference signal for improving the left-and-right difference signal of the stereo audio signal.

The first gain adjusting unit 53 controls the gain of the input error signal 103 by multiplying it by a preset fixed value or a value that can be set properly from an external control panel or the like not shown, and supplies the error signal 503 after the gain adjustment to the third adder 55.

The second adder 52, receiving the left signal l(n) 101 and right signal r(n) 102, adds the left signal l(n) 101 and right signal r(n) 102 in opposite phase, and supplies to the second gain adjusting unit 54 as a second addition signal 502.

The second gain adjusting unit 54 controls the gain of the input second addition signal 502 by multiplying it by a preset fixed value or a value that can be set properly from an external control panel or the like not shown, and supplies the second addition signal 504 after the gain adjustment to the third adder 55 as the improving difference signal.

The third adder 55 adds the error signal 503 from the first gain adjusting unit 53 and the second addition signal 504 from the second gain adjusting unit, and supplies a third addition signal 505 to the fourth adder 57 and fifth adder 58 as a new improving difference signal.

The fourth adder 57 adds the first addition signal 501 fed from the first adder 51 and the third addition signal 505 fed from the third adder 55, and supplies the left signal lout(n) 109 to the external output device 3 as an output signal after the signal processing.

The fifth adder 58 adds the first addition signal 501 fed from the first adder 51 and the third addition signal 505 fed from the third adder 55 in opposite phase, and supplies the right signal rout(n) 110 to the external output device 3 as an output signal after the signal processing.

Incidentally, in the embodiment 2 also, the left signal l(n) 101 and the right signal r(n) 102 can be exchanged. Thus, a configuration can suffice as long as it predicts a second signal from a first signal or vice versa.

As described above, according to the embodiment 2, it is configured in such a manner that the first gain adjusting unit 53 controls the gain of the error signal 103 to make the error signal 503, the second gain adjusting unit 54 controls the gain of the second addition signal 502 to make the second addition signal 504, the third adder 55 adds the error signal 503 and the second addition signal 504 to make the third addition signal 505, the fourth adder 57 adds the third addition signal 505 and the left signal l(n) 101, and the fifth adder 58 adds to the right signal r(n) 102 the third addition signal 505 with its phase being inverted. Accordingly, it offers an advantage of being able to adjust the improving difference signal in a finer manner.

For example, to increase an improvement effect, it is enough to reduce the coefficient of the second gain adjusting unit 54 and to increase the coefficient of the first gain adjusting unit 53. In contrast, to reduce the improvement effect, it is enough to increase the coefficient of the second gain adjusting unit 54 and to reduce the coefficient of the first gain adjusting unit 53. Furthermore, it is also possible to make the coefficient of the second gain adjusting unit 54 comparable to the coefficient of the first gain adjusting unit 53.

Furthermore, when the intensity of the left-and-right difference signal increases too much, the central component of the stereo audio signal becomes weak and a comfortable sound field feeling is impaired. According to the embodiment 2, however, it can curb the excessive increase of the left-and-right difference signal intensity, thereby offering an advantage of being able to achieve a stable sound field feeling.

Incidentally, although the embodiments 1 and 2 are designed for the signal processing of the stereo audio signal passing through the compression encoding, this is not essential. For example, it can also use a stereo audio signal that does not undergo compression encoding. In this case, the configuration as to the embodiment 1 or 2 can further increase the information about the left-and-right difference signal of the stereo audio signal, thereby offering an advantage of being able to achieve a richer sound field feeling and atmospheric feeling.

Furthermore, inputting a sensor signal instead of the stereo audio signal offers an advantage of being able to obtain a measurement result at higher accuracy.

Industrial Applicability

A signal processing device in accordance with the present invention can restore the characteristics of the signal before the compression encoding. As a result, it can restore the characteristics of the left-and-right difference signal of the stereo audio signal, for example, thereby being able to recover a rich sound field feeling or atmospheric feeling. Accordingly, it is suitable for applications to signal processing devices which decode and play back a compression-encoded audio signal.

What is claimed is:

1. A signal processing device comprising:

a prediction error calculating unit that receives a first signal and a second signal, and calculates an error signal between the first signal and a prediction signal of the first signal, which is predicted from the second signal;

a first gain adjusting unit that controls a gain of the error signal;

a first adder that adds the first signal and the second signal in phase, and outputs a result of said addition as a first addition signal;

a second adder that adds the first signal and the second signal in opposite phase, and outputs a result of said addition as a second addition signal;

a second gain adjusting unit that controls a gain of the second addition signal;

a third adder that adds the error signal from the first gain adjusting unit and the second addition signal from the second gain adjusting unit in phase, and outputs a result of said addition as a third addition signal;

a fourth adder that adds the first addition signal and the third addition signal in phase; and a fifth adder that adds the first addition signal and the third addition signal in opposite phase.

2. The signal processing device according to claim 1, wherein the prediction error calculating unit comprises an AR (Auto-Regressive) prediction unit that predicts the first signal from the second signal and a prediction coefficient.

3. The signal processing device according to claim 2, wherein the prediction error calculating unit inputs the error signal to the AR prediction unit, and the AR prediction unit updates the prediction coefficient in accordance with the error signal.

4. The signal processing device according to claim 1, wherein the first gain adjusting unit and the second gain adjusting unit control the gain of the error signal and the gain of the second addition signal, respectively, by multiplying a value properly set.

5. The signal processing device according to claim 1, wherein the prediction error calculating unit receives a left signal and a right signal of a stereo audio signal as the first signal and the second signal.

* * * * *